United States Patent [19]

Unmuth et al.

[11] Patent Number: 4,755,279

[45] **Date of Patent: * Jul. 5, 1988**

[54] PROCESS FOR THE MANUFACTURE OF LUBRICATING OILS

[75] Inventors: Eugene E. Unmuth, Naperville; John A. Mahoney, Glen Ellyn; Ralph J. Bertolacini, Naperville, all of Ill.

[73] Assignee: Amoco Corporation, Chicago, Ill.

[ * ] Notice: The portion of the term of this patent subsequent to Dec. 24, 2002 has been disclaimed.

[21] Appl. No.: 686,096

[22] Filed: Dec. 24, 1984

[51] Int. Cl.[4] ..... C10G 67/04

[52] U.S. Cl. ..... 208/87; 208/89; 208/110

[58] Field of Search ..... 208/87, 89, 110, 111

[56] References Cited

U.S. PATENT DOCUMENTS

| | | | |
|---|---|---|---|
| 4,124,489 | 11/1978 | Reid | 208/87 |
| 4,213,847 | 7/1980 | Chen et al. | 208/111 |
| 4,394,249 | 7/1983 | Shen | 208/89 |
| 4,434,047 | 2/1984 | Hensley, Jr. et al. | 208/111 |
| 4,435,311 | 3/1984 | Sikkenga | 502/22 |
| 4,515,680 | 5/1985 | Hettinger, Jr. et al. | 208/87 |
| 4,560,469 | 12/1985 | Hopkins et al. | 208/110 |
| 4,563,266 | 1/1986 | Hopkins et al. | 208/110 |
| 4,636,299 | 1/1987 | Unmuth et al. | 208/87 |
| 4,648,958 | 3/1987 | Ward | 208/59 |
| 4,664,775 | 5/1987 | Maejima et al. | 208/89 |
| 4,695,365 | 9/1987 | Ackelson et al. | 208/89 |

*Primary Examiner*—Olik Chaudhuri

*Attorney, Agent, or Firm*—Ekkehard Schoettle; William H. Magidson; Ralph C. Medhurst

[57] ABSTRACT

The present invention provides for a process for reducing the pour point of a hydrocarbon feedstock containing nitrogen- and sulfur-containing impurities. The hydrocarbon feedstock is contacted with hydrogen and a hydrotreating catalyst under hydrotreating conditions whereby a portion of the nitrogen- and sulfur-containing compounds are converted to hydrogen sulfide and ammonia. A portion of the hydrotreater effluent is then passed to a dewaxing zone and contacted with hydrogen under dewaxing conditions in the presence of a borosilicate-containing dewaxing catalyst.

24 Claims, No Drawings

PROCESS FOR THE MANUFACTURE OF LUBRICATING OILS

BACKGROUND OF THE INVENTION

This invention relates to a process for dewaxing petroleum oils and fractions thereof by selectively removing normal paraffinic and other undesirable hydrocarbons from petroleum oils in which they are present in admixture with other hydrocarbons, in order to lower the pour point of such oils. More specifically, the present invention relates to a particular combination and sequence of catalytic unit processes whereby a lube oil is produced having a low pour point and a high viscosity index.

In the preparation of lube oils from hydrocarbon feeds, catalytic dewaxing processes are often combined with hydrotreating, hydrocracking and/or various solvent extraction steps to obtain products having desired properties. Typically, hydrocracking and/or solvent extraction steps are conducted prior to catalytic dewaxing to remove components such as metal-containing feed components, asphaltenes and polycyclic aromatics having properties that differ grossly from those desired. In particular, solvent extraction is conducted to remove polycyclic aromatic feed components and nitrogen-containing cyclic components, removal of the latter being particularly important in order to avoid poisoning of catalyst in catalytic dewaxing. Hydrotreating under mild or severe conditions typically follows catalytic dewaxing operations and serves to improve oxidation stability and reduce the nitrogen and sulfur content of the lubeoil.

As one example of a process for producing lube oils in which a catalytic dewaxing step is included as part of a multistep process, U.S. Pat. No.4,259,170 (Graham et al.) discloses a process that includes a combination of catalytic dewaxing and solvent dewaxing steps. According to a more specific aspect of Graham et al., the process includes a solvent extraction step prior to a dewaxing step where any suitable solvent may be used such as furfural, phenol, chlorex, nitrobenzene, or N-methyl-pyrrolidone. As a further example of a multistep process for preparation of lube oils, U.S. Pat. No. 4,259,174 (Chen et al.) discloses a process comprising solvent extraction followed by catalytic dewaxing.

U.S. Pat. No. 4,283,272 (Garwood et al.) discloses preparation of lube oils by a process that includes hydrocracking, catalytic dewaxing and hydrotreating steps.

U.S. Pat. No. 4,292,166 (Gorring et al.) discloses a combination process wherein a dewaxing step is carried out prior to a hydrocracking step. Specifically, a hydrocarbon oil feed selected from the group consisting of vacuum gas oils, deasphalted oils and mixtures thereof is converted to a low pour point, high VI lube base stock by first dewaxing the feed in the presence of hydrogen and a dewaxing catalyst comprising a zeolite having a Constraint Index of 1 to 12 followed by contacting the dewaxed feedstock and hydrogen with a hydroconversion catalyst comprising a platinum group metal and a zeolite having a silica to alumina ratio of at least 6. Gorring et al. also contemplates interposing a conventional hydrotreating step between catalytic dewaxing and the hydrocracking step where the feed to the process contains high levels of deleterious nitrogen compounds.

A combination process is also disclosed in U.S. Pat. No. 4,358,363 (Smith) wherein a fuel oil, containing impurities deleterious to the catalyst is first treated with a sorbent comprising a first molecular sieve zeolite having pores with an effective diameter of at least about 5 Angstroms under sorption conditions followed by a treatment with a dewaxing catalyst comprising a second molecular sieve zeolite having pores with an effective diameter of at least about 5 Angstroms and equal to or smaller than the effective diameter of the pores of the first molecular sieve zeolite. In a more specific aspect of the disclosure, the first and second molecular sieves have the same crystal structure wherein the Constraint Index is 1 to 12 and the dried hydrogen form crystal density is less than about 1.6 grams per cubic centimeter.

The Patentee indicates that the effectiveness of the dewaxing catalyst is increased when catalyst poisons speculated to be basic nitrogen compounds and oxygen and sulfur compounds are removed. The teachings of U.S. Pat. No. 4,282,085 (O'Rear et al.) likewise appreciate the deleterious effect of nitrogen-containing impurities on ZSM-5-type crystalline aluminosilicate containing catalysts. Specifically, patentees disclose a process for upgrading a petroleum distillate feed with a catalyst comprising ZSM-5-type zeolite possessing no hydrogenation activity wherein the feed has a content of nitrogen-containing impurities, calculated by weight as nitrogen below about 5 ppm. The low-nitrogen feedstock results in a lower deactivation rate for the catalyst.

U.S. Pat. No. 4,153,540 (Gorring et al.) discloses a process for upgrading full range shale oil. More specifically, Patentee's process involves contacting the full range shale oil with a hydrotreating catalyst and hydrogen in order to convert organic compounds of sulfur, nitrogen, oxygen, and metal. The effluent from the hydrotreater is then passed to a dewaxing zone and contacted with dewaxing catalyst at conversion conditions calculated to hydrodewax the shale oil and convert at least 50% of the shale oil boiling above about 750° F. to reaction products boiling below 750° F.

Of the various solvent extraction processes, the most prevalent solvent employed is phenol. Other solvents employed include low boiling point autorefrigerative hydrocarbons, such as propane, propylene, butane, pentane, etc., liquid sulfur dioxide, furfural, and N-methyl-2-pyrrolidone (NMP). NMP is a preferred solvent because it is less toxic in relation to the above-mentioned solvents and requires less energy to effect the extraction.

Generally, when the solvent-extracted raffinate base stocks are dewaxed with a shape selective zeolite, the viscosity index of the product oil is reduced to a greater extent than if the same stock were solvent dewaxed. This is because shape selective dewaxing catalysts reduce pour point by normal and near normal paraffin cracking which results in a concentration of low VI possessing aromatics in the product oil. Some shape selective molecular sieves are more selective than others in VI retention during dewaxing because their selectivity for normal paraffin cracking versus isoparaffin cracking is high which results in the retention of high VI isoparaffins in the oil. For instance, even though the borosilicate molecular sieve as disclosed in U.S. Pat. No. 4,269,813 (Klotz) falls in the category of high VI selective catalysts, the VI loss relative to solvent dewaxing is in the range of 8–12 VI units for phenol-extracted SAE 10 raffinate. This loss would have to be compensated for by more severe solvent extraction of aromatics which is expensive and energy consuming.

The loss in VI attributed to catalytic hydrodewaxing in comparison to solvent dewaxing is also noted in a paper entitled "Hydrodewaxing of Fuels and Lubricants using ZSM-5 type Catalysts," by R. G. Graven and J. R. Green presented at the Australian Institute of Petroleum 1980 Congress. Therein it is mentioned that the VI for neutral distillate charge stocks dewaxed in the presence of a ZSM-5 catalyst is lower by 3 to 8 units than comparable quality solvent dewaxed neutrals.

In a paper presented at the 1983 NPRA annual meeting entitled "Low-Temperature Performance Advantages for Hydrodewaxed Base Stocks and Products," by C. N. Rowe, and J. A. Murphy, there is also pointed out that the VI differential between the catalytic dewaxing process disclosed therein and conventional solvent dewaxing ranges between 6 and 10 units for light neutrals feedstocks to little or no difference for bright feedstocks.

We have observed that not all solvent raffinates can be subsequently catalytically dewaxed on an equivalent basis. In particular, the high nitrogen content levels, particularly basic nitrogen compounds, in certain solvent-extracted raffinates are believed to be responsible for the rapid deactivation of the dewaxing catalyst.

For instance, we have found NMP-extracted raffinates to be substantially more difficult to dewax over a shape-selective dewaxing catalyst, i.e., greater deactivation rate than phenol-extracted raffinates.

Thus, the prior art combination dewaxing systems and teachings can be summarized as follows. Hydrotreating is typically carried out subsequent to the catalytic dewaxing step to improve color, color stability, and hydrogenate olefins. The deleterious effect of nitrogen on aluminosilicate-containing catalytic dewaxing catalysts is known, especially when a high nitrogen content shale oil is upgraded in a hydrodewaxing zone wherein at least 50% conversion occurs. The art is silent with respect to recognition of the detrimental effect of NMP extraction carried out prior to dewaxing on dewaxing catalyst activity, as the art considers the various solvents to be equivalent aside from disparate cost and toxicity. Finally, the art is silent with respect to the VI improvement achievement in a catalytic dewaxing zone when the influent thereto is hydrotreated.

The process of the present invention obviates the rapid deactivation phenomenon described above while simultaneously, surprisingly, increasing the viscosity index (VI) and reducing the pour point of the lube stock.

Accordingly, it is an object of the present invention to provide a process which obviates the VI debit associated with catalytic dewaxing while simultaneously prolonging the activity of the dewaxing catalyst. These and other objects will become evident to one skilled in the art on reading this entire specification including the appended claims.

BRIEF SUMMARY OF THE INVENTION

The process of the present invention relates to a process for reducing the pour point of a hydrocarbon feedstock containing nitrogen and sulfur-containing compounds which process involves initially passing the hydrocarbon feedstock to a hydrotreating zone wherein hydrogen is contacted with the hydrocarbon feedstock in the presence of a hydrotreating catalyst at hydrotreating conditions wherein a substantial portion of the nitrogen and sulfur containing compounds are converted to hydrogen sulfide and ammonia.

At least a portion of the effluent from the hydrotreating zone is then passed to a stripping zone wherein hydrogen sulfide and ammonia are removed to form a stripping zone effluent.

At least a portion of the stripping zone effluent is then passed to a dewaxing zone wherein hydrogen is contacted with stripping zone effluent at catalytic dewaxing conditions in the presence of a catalyst composition comprising a borosilicate molecular sieve and at least one hydrogenation component selected from the Group consisting of Group VIB and Group VIII metals.

The process of the invention serves to reduce the pour point of the hydrocarbon feedstock and increase the feedstock's VI.

In another embodiment of the present invention, the hydrocarbon feedstock is solvent extracted with a solvent to remove a portion of the aromatic compounds contained therein to form an extraction zone effluent, at least a portion of which is passed to the hydrotreating zone.

In a preferred embodiment, the above extraction step is carried out with NMP. Failure to hydrotreat subsequent to NMP extraction leads to premature poisoning, i.e., poor stability of the borosilicate sieve.

DETAILED DESCRIPTION OF THE INVENTION

Briefly, the present invention comprises a process for reducing the pour point of a hydrocarbon feedstock containing nitrogen and sulfur-containing compounds which process comprises passing the hydrocarbon feedstock to hydrotreating zone wherein hydrogen is contacted with the hydrocarbon feedstock in the presence of a hydrotreating catalyst at hydrotreating conditions wherein a substantial portion of the nitrogen and sulfur-containing compounds are converted to hydrogen sulfide and ammonia.

At least a portion of the effluent from the hydrotreating zone is then passed to a stripping zone where hydrogen sulfide and ammonia are removed from the hydrotreating zone effluent to form a stripping zone effluent.

At least a portion of the stripping zone effluent is then passed to a dewaxing zone wherein hydrogen is contacted with the stripping zone effluent at catalytic dewaxing conditions in the presence of a catalyst composition comprising a borosilicate molecular sieve and at least one hydrogenation component selected from the group consisting of Group VIB and Group VIII metals.

Without wishing to be bound by theory, it is believed that the nitrogen removal to very low levels effected in the hydrotreating stage results in higher dewaxing activity because the acid sites in the shape selective molecular sieve component of the dewaxing catalyst are not poisoned by basic nitrogen compounds or ammonia. Further, it is believed that because the sulfur level is also reduced to very low levels during the hydrotreating stage, there is a diminished opportunity for the sulfur to poison the hydrogenation component function in the dewaxing catalyst. This results in increased aromatics saturation in the dewaxing zone and, hence, an increase in the VI of the lube base stock. In the prior art processes where the feed to the dewaxing stage was not hydrotreated, the VI of the product tended to decrease because aromatics are unreactive in the presence of a poisoned hydrogenation component and hence are concentrated in the lube oil fraction by the normal paraffin cracking taking place.

The present invention can be carried out with various hydrocarbon feed materials, such as petroleum or synthetic crude oil fractions, which may contain appreciable quantities of aromatics and impurities such as sulfur or nitrogen.

In greater detail, the hydrocarbon feed materials employed according to the present invention are whole petroleum or synthetic crude oils, coal or biomass liquids, or fractions thereof. Narrower fractions include fuel oils, waxy lube oil distillates, waxy lube oil solvent raffinates and lube oil distillates or raffinates which have been previously partially dewaxed by solvent dewaxing, e.g., toluene-methyl ethyl ketone propane dewaxing.

The process of the present invention gives particularly good results with respect to feeds which contain appreciable amounts of sulfur and nitrogen, especially where nitrogen is in the form of basic nitrogen compounds.

In a preferred embodiment of the present invention, the process is employed to treat NMP extracted raffinates. NMP extracted raffinates are not equivalent to other solvent extracted raffinates in that they have been found to rapidly deactivate a dewaxing catalyst. The NMP extracted raffinates have a relatively high basic nitrogen compound content especially when compared with phenol-extracted raffinates. NMP is a preferred solvent by virtue of its low toxicity. The NMP extraction step is carried out in a conventional fashion.

The solvent, or NMP, extraction step is carried out to extract a portion of the aromatics present in the hydrocarbon feed. Optionally the raffinate phase can be processed to remove any entrained and dissolved solvent.

Solvent ratios vary from 0.5 volumes solvent recycled per volume of feed to 5 volumes solvent recycled per volume feed. Extraction is typically carried out in a number of counter-current washing stages. Columns containing perforated plates, bubble caps, and channel trays, similar to those used for distillation operations are often employed. Another typical contacting device is a Shell rotating disc contactor. The subject contactor consists of a vertical vessel fitted with a series of stator rings fixed to the wall together with a central rotating shaft carrying a number of discs, one to each of the compartments formed by the stator rings.

In any event, up to about 2.0 wt % sulfur, 1.5 wt % oxygen and 1.5 wt % nitrogen can be present in the feed stream to the hydrotreater without adversely affecting the process of the invention. Good results are achieved with feeds containing sufficiently high levels of waxy components as to exhibit pour points of at least 30° F. Other suitable feed materials include distillate fractions boiling above about 500° F. and having pour points of about 50° to about 150° F. Both vacuum and atmospheric distillate fractions are contemplated according to the invention as are deasphalted resids.

Suitable operating conditions in the hydrotreating zone are summarized in Table 1.

TABLE 1

HYDROTREATING OPERATING CONDITIONS

| Conditions | Broad Range | Preferred Range |
|---|---|---|
| Temperature, °F. | 400–850 | 500–750 |
| Total pressure, psig | 50–4,000 | 400–1800 |
| LHSV | .10–20 | .25–2.5 |
| Hydrogen rate, SCFB | 500–20,000 | 800–6,000 |

TABLE 1-continued

HYDROTREATING OPERATING CONDITIONS

| Conditions | Broad Range | Preferred Range |
|---|---|---|
| Hydrogen partial pressure, psig | 50–3,500 | 500–1,000 |

The hydrotreater is also preferably operated at conditions that will result in an effluent stream having less than 10 ppmw nitrogen-containing impurities, based on nitrogen, and less than 20 ppmw sulfur-containing impurities, based on sulfur, and most preferably less than 5 ppmw and 10 ppmw, respectively. The above-set out preferred nitrogen and sulfur contents correspond to substantial conversion of the sulfur and nitrogen compounds entering the hydrotreater.

The catalyst employed in the hydrotreater can be any conventional and commercially available hydrotreating catalyst. The subject hydrotreating catalysts typically contain one or more elements from Groups IIB, VIB, and VIII supported on an inorganic refractory support such as alumina. Catalysts containing NiMo, NiMoP, CoMo, CoMoP, and NiW are most prevalent.

Other suitable hydrotreating catalysts for the hydrotreating stage of the present invention comprise a Group VIB metal component or non-noble metal component of Group VIII and mixtures thereof, such as cobalt, molybdenum, nickel, tungsten and mixtures thereof. Suitable supports include inorganic oxides such as alumina, amorphous silica-alumina, zirconia, magnesia, boria, titania, chromia, beryllia, and mixtures thereof. The support can also contain up to about 20 wt. % zeolite based on total catalyst weight. A preferred hydrotreating catalyst contains sulfides or oxides of Ni and Mo composited with an alumina support wherein the Ni and Mo are present in amounts ranging from 0.1 wt. % to 10 wt. % calculated as NiO and 1 wt. % to 20 wt. % calculated as $MoO_3$ based on total catalyst weight.

Prior to the dewaxing step, the $H_2S$ and $NH_3$ is stripped from the hydrotreater effluent in a conventional manner in a gas-liquid separation zone.

The dewaxing zone contains a catalyst capable of pour point reduction comprising a borosilicate molecular sieve and a hydrogenation component. The sieve material can be dispersed in a matrix of at least one non-zeolitic, porous refractory inorganic oxide matrix component as the use of such a matrix component facilitates.

The hydrogenation component is selected from the group consisting of Group VIB metals and Group VIII metals.

One class of borosilicate molecular sieves useful as the shape selective component of the catalysts employed according to the present invention is the shape selective crystalline borosilicates of the AMS type. Such materials have the following composition in terms of mole ratios of oxides, $$0.9\pm0.2\ M_{2/n}O:B_2O_3:YSiO_2:ZH_2O$$

wherein M is at least one cation having a valence of n, Y ranges from about 4 to about 600 and Z ranges from 0 to about 160, and provide an X-ray diffraction pattern comprising the following X-ray diffraction lines and assigned strengths.

| d (Å) | Assigned Strength |
|---|---|
| 11.2 ± 0.2 | W-VS |
| 10.0 ± 0.2 | W-MS |
| 5.97 ± 0.07 | W-M |
| 3.82 ± 0.05 | VS |
| 3.70 ± 0.05 | MS |
| 3.62 ± 0.05 | M-MS |
| 2.97 ± 0.02 | W-M |
| 1.99 ± 0.02 | VW-M |

Such crystalline borosilicates typically are prepared by reaction of boron oxide and a silicon-containing material in a basic medium. Further details with respect to these shape selective crystalline borosilicate components are found in commonly assigned U.S. Pat. No. 4,269,813 (Klotz), which is incorporated herein by reference, wherein the AMS-1B crystalline borosilicate molecular sieve is disclosed.

AMS-1B crystalline borosilicate molecular sieves can also be prepared by crystallizing a mixture of an oxide of silicon, an oxide of boron, an alkylammonium compound and ethylenediamine. This method is carried out in a manner such that the initial reactant molar ratios of water to silica range from about 5 to about 25, preferably about 10 to about 22, and most preferably about 10 to about 15. In addition, preferable molar ratios for initial reactant silica-to-oxide of boron range from about 4 to about 150, more preferably about 5 to about 80, and most preferably about 5 to about 20. The molar ratio of ethylenediamine to silicon oxide used in the preparation of AMS-1B crystalline borosilicate should be above about 0.05, typically below about 5, preferably about 0.1 to about 1.0, and most preferably about 0.2 to about 0.5. The molar ratio of alkylammonium template compound or precursor-to-silicon oxide useful in the instant preparation can range from 0 to about 1 or above, typically above about 0.001, preferably about 0.05 to about 0.1, and most preferably from about 0.005 to about 0.02. The silica source is preferably a low sodium content silica source containing less than 2,000 ppmw Na and most preferably less than 1,000 ppmw Na, such as Ludox AS-40 which contains 40 wt. % $SiO_2$ and 0.08 wt. % $Na_2O$ or Nalco 2327 which has similar specifications.

It is noted that the preferable amount of alkylammonium template compound used in the instant preparation method is substantially less than that required to produce AMS-1B conventionally using an alkali metal cation base. The borosilicate prepared by the instant method typically contains at least 9,000 ppmw boron and less than about 100 ppmw sodium and is designated as HAMS-1B-3.

The HAMS-1B-3 crystalline borosilicate has a higher boron content and a lower sodium content than crystalline borosilicates formed using conventional techniques.

Although not required, it is preferred to employ the above-described shape selective molecular sieve component dispersed in a matrix of at least one non-molecular sieve, porous refractory inorganic oxide matrix component as the use of such a matrix component facilitares provision of the ultimate catalyst in a shape or form well suited for process use. Useful matrix components include alumina, silica, silica-alumina, zirconia, titania, etc., and various combinations thereof. The matrix component also can contain various adjuvants such as phosphorus oxides, boron oxides and/or halogens such as fluorine or chlorine. Usefully, the molecular sieve-matrix dispersion contains about 5 to about 70 wt % zeolite component and about 30 to about 95 wt % matrix component.

Methods for dispersing molecular sieve marerials within a matrix component are well known to persons skilled in the art and applicable with respect to the shape selective molecular sieve materials employed according to the present invention. A preferred method is to blend the shape selective molecular sieve component, preferably in finely-divided form, in a sol, hydrosol or hydrogel of an inorganic oxide, and then add a gelling medium such as ammonium hydroxide to the blend with stirring to produce a gel. The resulting gel can be dried, shaped if desired, and calcined. Drying preferably is conducted in air at a temperature of about 80° to about 350° F. (about 27° to about 177° C.) for a period of several seconds to several hours. Calcination preferably is conducted by heating in air at about 800° to about 1,200° F. (about 427° to about 649° C.) for a period of time ranging from about ½ to about 16 hours.

Another suitable method for preparing a dispersion of shape selective molecular sieve component in a porous refractory oxide matrix component is to dry blend particles of each, preferably in finely-divided form, and then shape the dispersion if desired.

Relative proportions of the shape selective molecular sieve component and hydrogenating components of the catalysts are such that at least a catalytically effective amount of each is present. Preferably, catalysts employed according to the invention contain about 10 to about 70 wt % based on total catalyst weight of the molecular sieve component and about 0.1 to about 20 wt % of the hydrogenating component. More preferably, molecular sieve component concentration ranges from abour 30 to about 50 wt % in order to attain a desirable degree of selective cracking activity while avoiding inclusion in the catalyst of amounts of molecular sieve component that unduly increase the cost of the ultimate catalyst. When the molecular sieve component is employed as a dispersion in a matrix component, preferred matrix component content ranges from about 20 to about 70 wt % based on rotal catalyst weight.

The hydrogenation component of the catalyst employed according to the present invention comprises a metal selected from the group consisting of Group VIB metals and Group VIII metals. The metal components can be present in elemental form, as oxides or sulfides, or as combinations thereof. Useful Group VIII metals include iron, cobalt, nickel, ruthenium, rhodium, palladium, osmium, iridium and platinum. Among these, palladium and platinum are most preferred owing to their superior hydrogenating activities. Content of the Group VIB metal component, calculated as hexavalent metal oxide, preferably ranges from about 1 to about 20 wt. % with about 7 to about 18 wt. % being more preferred from the standpoint of hydrogenating activity based on total catalyst weight. Group VIII metal content, calculated as divalent metal oxide in the case of cobalt, nickel and/or iron, preferably ranges from about 0.1 to about 10 wt. % with about 0.5 to about 5 wt. % being more preferred in terms of hydrogenation activity. Higher levels of metals can be employed if desired though the degree of improvement resulting therefrom typically is insufficient to justify the added cost of the metals.

The hydrogenating component of the catalyst employed according to this invention can be associated with the shape selective molecular sieve cracking component by impregnation of the molecular sieve component, or molecular sieve component dispersed in a porous refractory inorganic oxide matrix, with one or more solutions of compounds of the metals of the hydrogenating component which compounds are convertible to oxides on calcination. It also is contemplated, however, to impregnate a porous refractory inorganic oxide matrix component with such solutions of the metal components and then blend the molecular sieve component with the resulting impregnation product. Accordingly, the present invention contemplates the use of catalysts in which hydrogenating component is deposed on the molecular sieve component or on a molecular sieve-matrix component dispersion or on the matrix component of a molecular sieve-matrix dispersion.

The mechanics of impregnating the molecular sieve component, matrix component or molecular sieve matrix composite with solutions of compounds convertible to metal oxides on calcination are well known to persons skilled in the art and generally involve forming solutions of appropriate compounds in suitable solvents, preferably water, and then contacting the molecular sieve matrix component or molecular sieve matrix dispersion with an amount or amounts of solution or solutions sufficient to deposit appropriate amounts of metal or metal salts onto the molecular sieve or molecular sieve-matrix dispersion. Useful metal compounds convertible to oxides are well known to persons skilled in the art and include various ammonium salts, as well as metal acetates, nitrates, anhydrides, etc.

The original cation associated with the molecular sieve, i.e., the alkali metal cations, ammonium cations, or hydrogen cations, can be replaced at least in part by ion exchange with hydrogenation metal component-containing ions by techniques which are known in the art. Ion exchange techniques known in the art are disclosed in many patents including U.S. Pat. Nos. 3,140,249, 3,140,250, and 3,140,253, the teachings of which are incorporated by reference into this specification.

The above-described catalysts can be employed in any suitable form such as spheres, extrudate, pellets, C-shaped or cloverleaf-shaped particles.

The dewaxing process is suitably operated at the conditions set out below in Table 2.

TABLE 2

DEWAXING OPERATING CONDITIONS

| Conditions | Broad Range | Preferred Range |
|---|---|---|
| Temperature, °F. | 500–900 | 500–750 |
| Total pressure, psig | 100–3,000 | 300–900 |
| LHSV | 0.1–20 | 0.2–5 |
| Hydrogen rate, SCFB | 500–20,000 | 2,000–5,000 |
| Hydrogen partial pressure, psig | 50–2,500 | 300–800 |

As noted above, the preferred dewaxing catalyst is one where the molecular sieve component is a crystalline borosilicate component of the AMS-1B type in hydrogen form where the hydrogenation component is palladium.

Products obtained according to this aspecr of the invention exhibit low pour points, high viscosity index and good stability. Preferably, pour point ranges from about −30 to about +20 and viscosity index ranges from about 70 to about 95.

The present invention is described in further detail in connection with the following example, it being understood that the same is for purposes of illustration and not limitation.

EXAMPLE I

An NMP-extracted SAE 10 raffinate was hydrotreated in a fixed bed, downflow, pilot plant associated with automatic controls to maintain constant flow of gas and feed and constant temperature and pressure. 128 cc of HDS-3A, a commercially available American Cyanamid Ni-Mo-containing hydrotreating catalyst were loaded into a 0.75" inside diameter reactor having a bed length of 20-½". The catalyst was presulfided with 8 vol % $H_2S$ in hydrogen at 300° F. for one hour, 400° F. for one hour, and 600° F. for one hour. The feed was then hydrotreated at a total unit pressure of 800 psig, a temperature of 675° F., and a liquid feed rate of 0.50 volumes of feed per volume of catalyst per hour (LHSV) ($V_o/V_c$/hrs) at a constant gas flow rate corresponding to 800 standard cubic feet per barrel (SCFB). The product was collected over several days and stripped of $H_2S$ in a five-gallon can with nitrogen until $H_2S$ could not be detected using a Drager tube.

The properties of a phenol extracted SAE 10 raffinate, the feed to the hydrotreater and hydrotreated product are set out below in Table 3:

TABLE 3

| | Phenol SAE 10 Raffinate | NMP SAE 10 Raffinate | Hydrotreated NMP SAE 10 Raffinate |
|---|---|---|---|
| API Gravity | 32.4 | 33.3 | 35.6 |
| Pour Point, °F. | 100 | 100 | 100 |
| KV @ 40° C. CSt | — | 25.03 | 18.46 |
| KV @ 100° C. CSt | 4.92 | 4.89 | 4.10 |
| Elemental Analysis | | | |
| C, wt % | 86.10 | 85.99 | 85.94 |
| H, wt % | 13.49 | 13.78 | 13.90 |
| S, ppm | 1720 | 1740 | 11 |
| Total N, ppm | 13 | 81 | 1.1 |
| Basic N, ppm | 7 | 54 | <5 |
| NMP, ppm | 0 | 11.5 | — |

A physical and chemical inspection analysis for HDS-3 hydrotreating catalyst is set out below in Table 4.

TABLE 4

CATALYST INSPECTION FOR HDS-3

| | |
|---|---|
| Composition | |
| $MoO_3$, wt. % | 15.3 |
| NiO, wt. % | 3.3 |
| Surface Properties | |
| BET Surface Area (digisorb method), $m^2/g$ | 202 |
| Pore Volume, cc/g in 20–50Å dia pores | 0.05 |
| 50–100 | 0.44 |
| 100–150 | 0.11 |
| 150–200 | 0.01 |
| 200+ | 0.02 |
| Total | 0.62 |
| Average pore diameter, Å | 123 |
| Bulk density, g/cc | 0.74 |

The dewaxing catalyst used in the dewaxing step of the present example in the process of the invention was prepared as follows.

HAMS-IB-3 was prepared by mixing ethylenediamine, $H_3BO_3$ acid, and tetra-n-propylammonium bromide (TPABr) in distilled water. To this mixture a quantity of 40 wt. % colloidal silica (Nalco 2327) was added. The mixture was then digested at about 145° to 150° C. until crystallization of the molecular sieve to a level of about greater than 80 wt. % occurred. The product was then filtered, washed with distilled water, dried at 200° C. for about 16 hours and then calcined at about 900° to 1000° F. for about 12 hours.

The mole ratios of the reactants were about as follows: $H_2O/SiO_2=15$, ethylenediamine/$SiO_2$=.30, $H_3BO_3/SiO_2=0.39$ and TPABr/$SiO_2$=0.011. The pH of the reaction mixture was about 9.8.

Sufficient alumina sol (containing approximately 9 wt. % $Al_2O_3$) and HAMS-1B-3 to make a 40 wt. % HAMS-1B-3/60 wt. % $Al_2O_3$ catalyst on a dry basis was placed in an Eirich intensive mixer. The slurry was blended for approximately one minute.

A gelling solution was prepared by mixing concentrated ammonium hydroxide solution (28.4 wt %) with distilled water to give a $NH_4OH$ concentration of about 22.7 wt. %. The gellation ratio was 0.20 g $NH_4OH$ per gram of $Al_2O_3$. 1.0 cc of diluted gelling solution was used per gram of $Al_2O_3$. The gelling solution was poured into the intensive mixer and the slurry was blended at a high rate for several minutes. The slurry was then removed from the intensive mixer and dried in an oven overnight at 250° F. The alumina-sieve cake was then broken up and ground to approximately 325 mesh in a Retch screen mill. The milled powder was returned to the intensive mixer where it was blended with distilled water and densified prior to extrusion. The dough mass was then extruded using a stainless steel die plate with 1/16" diameter holes. No extrusion aids were used in this preparation.

After extrusion, the extrudate was dried overnight at 250° F. in a convection oven. The extrudate was then dish calcined at 500° C. for three hours in an air-purged furnace. The finished base was analyzed by the Digisorb method and was found to have a BET surface area of 345 $m_2/g$, and a desorption pore volume of 0.7135 cc/g.

Palladium was then incorporated into the above-described base by the following procedure.

An impregnation solution was prepared such that it contained 0.6 g Pd/liter distilled water using a 10 wt % Pd, $Pd(NO_3)_2$ solution. $NH_4NO_3$ was also added in an amount such that the solution contained $NH_4NO_3$ in a concentration of 200 moles $NH_4OH$ per mole Pd.

The extrudate described above was then added to a drum which permitted circulation of the impregnation solution therethrough. The impregnation was continued for about two hours. After two hours, the solution, which had cleared, was decanted. The extrudate was then washed and decanted ten times with fresh distilled water and was finally filtered. The wet extrudate was subsequently dried at approximately 122° C. overnight to yield a finished catalyst. The finished catalyst was thereafter calcined for three hours in flowing air at 500° C.

The finished catalyst possessed the following properties as set out in Table 5:

TABLE 5

| CATALYST INSPECTION FOR DEWAXING CATALYST | |
|---|---|
| Palladium, wt % | 0.241 |
| Boron, wt % | 0.57 |
| Sodium, ppm | 78 |
| BET surface area, $m^2/g$ | 345 |
| Pore volume, cc/g | 0.7135 |

128 cc of the above-described catalyst were then loaded into a pilot plant. The subject pilot plant consisted of a five-zone, electrically heated ¾" diameter schedule 40 reactor. The reactor was operated in downflow, fixed-bed configuration with the temperatures being monitored with an axial travelling thermocouple. Gas and liquid products were recovered and analyzed and daily mass balances were taken. All runs were conducted at 800 psig. in pure hydrogen. The total gas flow rate was held at 5000 standard cubic feet per barrel at a liquid hourly space velocity of 0.50 volume of feed per volume of catalyst per hour.

After the catalyst charge was loaded in the reactor the catalyst was heated in flowing hydrogen at 800 psig to 550° F. and held there for 3 hours before oil was introduced. Phenol-extracted SAE 10 raffinate was then charged to the reactor for about 300 hours. The feed was then changed to NMP-extracted SAE 10 raffinate. After about 125 hours of NMP-extracted SAE 10 raffinate feed to the reactor, the dewaxing catalyst was rejuvenated. A hydrogen rejuvenation treatment was carried out overnight at 900° F. and 800 psig. Because the catalyst had undergone the above-described rejuvenation, the catalyst was first contacted with phenol-extracted SAE 10 raffinate for about 70 hours in order to determine how successful the rejuvenation had been. The initial lube oil pour point after rejuvenation was found to be −35° F. which indicated rejuvenation. Subsequently, the feed was switched to the hydrotreated NMP-extracted SAE 10 raffinate. The hydrotreating step was carried out as explained above.

DISCUSSION OF RESULTS

Table 6 below sets out the operating conditions and results for the run described above. In the Table, phenol-10 designates a phenol-extracted SAE 10 raffinate, NMP-10 designates a NMP-extracted SAE 10 raffinate, and HNMP-10 designates a hydrotreated NMP extracted SAE 10 raffinate.

TABLE 6

| Time on stream, hrs | 25 | 47 | 75 | 98 | 157 | 181 | 225 | 276 | 325 | 348 |
|---|---|---|---|---|---|---|---|---|---|---|
| Avg. Cat. Temp., °F. | 567 | 563 | 562 | 562 | 601 | 630 | 625 | 628 | 626 | 626 |
| LHSV | .50 | .50 | .50 | .50 | .50 | .50 | .50 | .50 | .50 | .50 |
| $H_2$, SCFB | 7866 | 7691 | 5343 | 5343 | 5286 | 5219 | 5219 | 5145 | 5294 | 5294 |
| Pressure, psig | 800 | 800 | 800 | 800 | 800 | 800 | 800 | 800 | 800 | 800 |
| Feed | phenol 10 | phenol 10 | phenol 10 | phenol 10 | phenol 10 | phenol 10 | phenol 10 | phenol 10 | NMP-10 | NMP-10 |
| Yields, wt % | | | | | | | | | | |
| Methane | .04 | .03 | .02 | .01 | .00 | .00 | .01 | .01 | .00 | .00 |
| Ethane | .17 | .17 | .11 | .05 | .04 | .04 | .08 | .08 | .04 | .04 |
| Propane | 5.77 | 5.64 | 4.09 | 2.80 | 3.79 | 3.75 | 4.87 | 4.80 | 3.75 | 3.75 |
| Butane | 7.38 | 7.22 | 5.21 | 3.99 | 4.49 | 4.43 | 5.27 | 5.19 | 4.56 | 4.56 |
| $C_5$+ naphtha | 14.89 | 14.08 | 16.78 | 13.33 | 13.90 | 11.26 | 16.13 | 15.54 | 12.23 | 9.26 |
| Distillate | 4.38 | 2.88 | 2.95 | 2.02 | 2.26 | 2.23 | 2.41 | 1.86 | 2.06 | 1.74 |
| Lube Oil | 57.02 | 57.64 | 80.19 | 76.95 | 76.27 | 70.54 | 73.61 | 71.34 | 79.35 | 81.45 |
| Total Liquid | 76.29 | 74.60 | 99.92 | 92.30 | 92.43 | 84.02 | 92.15 | 88.74 | 93.64 | 92.45 |

TABLE 6-continued

| | | | | | | | | | | |
|---|---|---|---|---|---|---|---|---|---|---|
| Properties of Lube Oil | | | | | | | | | | |
| Pour pt, °F. | −25 | −25 | 0 | 50 | 10 | −10 | −20 | −15 | 25 | 40 |
| Viscosity, cSt @ 100° C. | 6.25 | 6.18 | 5.98 | 5.80 | 5.82 | 5.76 | 5.77 | 5.70 | 5.82 | 5.76 |
| Viscosity, cSt @ 40° C. | 47.70 | 45.51 | 42.29 | 38.52 | 38.88 | 38.79 | 38.49 | 37.58 | 38.12 | 37.14 |
| Viscosity index | 68 | 74 | 78 | 88 | 87 | 84 | 86 | 87 | 91 | 93 |
| Sulfur, wt % | — | — | — | — | — | — | — | — | — | — |
| Nitrogen, ppm | 4.0 | 3.5 | 6.5 | 3.2 | 4.9 | 3.7 | 33.4 | 3.6 | 33.8 | 45.7 |
| Time on stream, hrs | 370 | 392 | 445 | 468 | 493 | 515 | 537 | 565 | 589 | 613 |
| Avg. Cat. Temp., °F. | 626 | 626 | 597 | 597 | 598 | 599 | 599 | 600 | 629 | 599 |
| LHSV | .50 | .50 | .50 | .50 | .50 | .50 | .50 | .50 | .50 | .50 |
| $H_2$, SCFB | 5294 | 5294 | 5111 | 4925 | 4949 | 4949 | 4949 | 5096 | 5106 | 4911 |
| Pressure, psig | 800 | 800 | 800 | 800 | 800 | 800 | 800 | 800 | 800 | 800 |
| Feed | NMP-10 | NMP-10 | phenol 10 | phenol 10 | HNMP-10 | HNMP-10 | HNMP-10 | HNMP-10 | HNMP-10 | HNMP-10 |
| Yields, wt % | | | | | | | | | | |
| Methane | .00 | .00 | .02 | .01 | .01 | .00 | .00 | .00 | .02 | .01 |
| Ethane | .02 | .02 | .18 | .09 | .09 | .02 | .02 | .03 | .13 | .05 |
| Propane | 2.48 | 2.48 | 4.83 | 3.82 | 3.91 | 2.56 | 2.56 | 2.97 | 5.95 | 4.08 |
| Butane | 3.23 | 3.23 | 6.70 | 2.93 | 3.00 | 3.20 | 3.20 | 3.57 | 6.06 | 4.79 |
| $C_5$+ naphtha | 10.44 | 10.04 | 21.71 | 19.29 | 14.24 | 14.26 | 16.01 | 17.60 | 23.87 | 19.97 |
| Distillate | 2.14 | 2.46 | 6.11 | 5.33 | 8.75 | 9.14 | 7.67 | 12.94 | 17.91 | 11.29 |
| Lube Oil | 80.25 | 71.91 | 55.04 | 60.74 | 66.59 | 68.94 | 70.87 | 63.87 | 42.73 | 59.97 |
| Total Liquid | 92.82 | 84.41 | 82.86 | 85.36 | 88.57 | 92.34 | 94.55 | 94.41 | 84.51 | 91.22 |
| Properties of Lube Oil | | | | | | | | | | |
| Pour pt, °F. | 50 | 55 | −35 | −15 | 15 | 25 | 15 | −15 | −70 | −40 |
| Viscosity, cSt @ 100° C. | 5.75 | 5.77 | 5.68 | 5.84 | 5.38 | 5.19 | 4.91 | 5.20 | 4.76 | 5.11 |
| Viscosity, cSt @ 40° C. | 36.86 | 36.48 | 39.01 | 40.04 | 32.91 | 30.57 | 28.04 | 30.92 | 27.55 | 30.55 |
| Viscosity index | 94 | 97 | 77 | 82 | 95 | 98 | 96 | 96 | 86 | 92 |
| Sulfur, wt % | — | — | — | — | — | — | — | — | — | — |
| Nitrogen, ppm | 50.9 | 54.3 | 5.2 | 5.5 | 2.6 | 1.6 | 1.1 | 5.9 | 1.7 | 2.9 |

As can be seen from Table 6, while the lube oil pour point during operation on the phenol-extracted SAE 10 raffinate remained relatively constant at about −15° F. upon introduction of the NMP-extracted SAE 10 raffinate, the lube pour point increased immediately by about 40° F. with a deactivation rate of about 11° F./day in pour point.

The only significant difference between the two SAE 10 feeds was the nitrogen content. NMP-extracted SAE 10 contained 54 ppm basic nitrogen, 81 ppm total nitrogen and 11.5 ppm NMP while the phenol SAE 10 raffinate contained only 7 ppm basic nitrogen, 13 ppm total nitrogen, and no NMP. While not wishing to be bound by any theory, it is speculated that the basic nitrogen molecules such as NMP and ammonia generated over the catalyst are small enough to enter the borosilicate pore structure and become adsorbed on the active acid sites. It is believed that because NMP-extracted feeds contain more basic nitrogen molecules than phenol-extracted feeds, a greater degree of poisoning and a consequent increase in deactivation results therefrom.

As can be further observed from Table 6, once the hydrotreated NMP-extracted raffinate was charged to the dewaxing reactor the pour point of the lube oil was found to increase from −15° F. for the phenol-extracted raffinate to +15° F. with the hydrotreated NMP-extracted feed. After about 3 days charge of the hydrotreated feed, the catalyst began to reactivate.

In order to achieve a direct comparison between the steady state catalyst performance with the phenol-extracted feed, NMP-extracted feed, and hydrotreated NMP extracted feed the reactor temperature was increased to 625° F. At these conditions, the pour point of the lube oil was dramatically decreased to −70° F., thus emphatically demonstrating the effect of hydrotreating to remove deleterious nitrogen compounds.

Another surprising result afforded by hydrotreating prior to dewaxing is the increase in VI achieved by the sequence of process steps prescribed by the invention. Typically, there is a decrease in VI after a dewaxing step, however, prior hydrotreatment of the dewaxing influent results in a dramatic increase in VI. It should be noted that the process of the present invention results in a product possessing a very high VI at an extremely low pour point. For example, at a pour point of −40° F. at period No. 25, the product possessed a VI of 92.

As mentioned above, it is speculated that the hydrotreatment step reduces the sulfur level content of the dewaxing stage influent to the point where the dewaxing catalyst dehydrogenation component is not poisoned by the sulfur. This results in increased aromatics saturation as well as paraffin isomerization activity. The net result of these reactions is a decrease in pour point and an increase in viscosity index.

The following Table 7 sets out the results of a mass spectral analysis carried out on certain feed and product samples from the instant example to determine actual conversion of aromatics at each stage.

TABLE 7

| | MASS SPEC. INSPECTIONS | | | | | |
|---|---|---|---|---|---|---|
| | Phenol SAE 10 | Dewaxed Phenol SAE 10 | NMP Extracted SAE 10 | Hydrotreated NMP SAE 10 | Dewaxed Hydrotreated NMP SAE 10 | Dewaxed Hydrotreated NMP SAE 10 |
| Mono Aromatics, Vol % | 6.0 | 6.0 | 6.4 | 4.7 | .5 | .8 |
| Total Aromatics, Vol % | 11.8 | 12.3 | 11.1 | 8.1 | 4.9 | 5.5 |
| Ave. Mol. Wt | — | 395 | 397 | 372 | 374 | 369 |
| Pour Pt, °F. | — | −15 | — | — | −15 | −40 |

TABLE 7-continued

| | MASS SPEC. INSPECTIONS | | | | | |
|---|---|---|---|---|---|---|
| | Phenol SAE 10 | Dewaxed Phenol SAE 10 | NMP Extracted SAE 10 | Hydrotreated NMP SAE 10 | Dewaxed Hydrotreated NMP SAE 10 | Dewaxed Hydrotreated NMP SAE 10 |
| VI | — | 87 | — | — | 96 | 92 |

As can be gleaned from the above table, while some aromatics saturation occurred in the hydrotreater, aromatics saturation in the dewaxing stage occurred when the feed thereto had been hydrotreated and did not occur to the same extent when the feed had not been prehydrotreated, as the dewaxed (absent hydrotreatment) phenol SAE 10 inspection shows a minor amount of aromatics hydrogenation when compared to the phenol SAE 10 feed. Furthermore it should be noted that such a significant aromatics saturation occurred at relatively low pressures.

EXAMPLE II

A phenol extracted SAE 10 feedstock possessing the properties as set out in Table 3 was solvent dewaxed in the following manner.

A dewaxing solvent containing 55 Vol% methyl ethyl ketone (MEK) and 45 Vol% toluene was employed. One part by volume of SAE 10 phenol extracted raffinate was dissolved in four parts solvent. The mixture was chilled overnight in a constant temperature box maintained at −18° F. Subsequently, the solution was filtered using a vacuum funnel followed by a washing of the filtercake with an additional volume of chilled solvent. The dewaxed lube oil was then stripped of the solvent using conventional atmospheric distillation. The following Table 8 sets out certain pertinent properties of the solvent dewaxed SAE 10 raffinate.

TABLE 8

| SOLVENT DEWAXED SAE 10 PHENOL RAFFINATE | |
|---|---|
| VI | 94 |
| Pour Point, °F. | +5 |

A comparison of the above values with those set out in Table 7 for catalytically dewaxed hydrotreated NMP SAE 10 shows that the process of the invention does not produce a VI decrease in the product as compared to solvent dewaxing.

What is claimed is:

1. A process for reducing the pour point of a hydrocarbon feedstock containing nitrogen and sulfur-containing compounds which process comprises:

passing the hydrocarbon feedstock to a hydrotreating zone wherein hydrogen is contacted with the hydrocarbon feedstock in the presence of a hydrotreating catalyst at hydrotreating conditions wherein a substantial portion of the nitrogen and sulfur-containing compounds are converted to hydrogen sulfide and ammonia to form a hydrotreating zone effluent;

passing at least a portion of the effluent from the hydrotreating zone to a stripping zone wherein hydrogen sulfide and ammonia are removed from the hydrotreating zone effluent to form a stripping zone effluent containing less than about 10 ppmw nitrogen-containing compounds based on nitrogen and less than about 20 ppmw sulfur-containing compounds based on sulfur to a dewaxing zone wherein hydrogen is contacted with the said stripping zone effluent at catalytic dewaxing conditions in the presence of a catalyst composition comprising a borosilicate molecular sieve and at least one hydrogenation component selected from the group consisting of platinum and palladium.

2. The process of claim 1 wherein the crystalline borosilicate is dispersed within a non-molecular sieve containing porous refractory inorganic oxide matrix component.

3. The process of claim 2 wherein the hydrogenation component is deposited on the dispersion of borosilicate and matrix components.

4. The process of claim 2 wherein the hydrogenation component is deposited on the matrix component of the borosilicate-matrix dispersion.

5. The process of claim 2 wherein the matrix component comprises alumina.

6. The process of claim 1 wherein the borosilicate molecular sieve comprises an AMS-1B crystalline borosilicate molecular sieve.

7. The process of claim 1 wherein the borosilicate molecular sieve contains less than about 100 ppmw sodium.

8. The process of claim 1 wherein the crystalline borosilicate molecular sieve is prepared by reacting under crystallization conditions, in the substantial absence of a metal or ammonium hydroxide, an aqueous mixture containing an oxide of silicon, an oxide of boron, and ethylenediamines, in a molar ratio to silica of above about 0.05.

9. The process of claim 1 wherein the crystalline borosilicate molecular sieve is prepared by reacting under crystallization conditions, in the substantial absence of a metal or ammonium hydroxide, an aqueous mixture containing an oxide of silicon, an oxide of boron, and ethylenediamine, in a molar ratio to silica of above about 0.05, wherein the crystalline borosilicate molecular sieve contains at least about 9,000 ppmw boron.

10. The process of claim 8 wherein the aqueous mixture further contains an alkylammonium cation or precursor of an alkylammonium cation.

11. The process of claim 9 wherein the aqueous mixture further contains an alkylammonium cation or precursor of an alkylammonium cation.

12. A process for reducing the pour point of a hydrocarbon feedstock containing nitrogen and sulfur-containing compounds which comprises:

passing the hydrocarbon feedstock to a solvent extraction zone wherein the hydrocarbon feedstock is extracted with a solvent to remove a portion of the aromatic compounds contained in the hydrocarbon and thereby form an extraction zone raffinate;

passing at least a portion of the extraction zone raffinate to a hydrotreating zone wherein hydrogen is contacted with hydrocarbon feedstock in the presence of a hydrotreating catalyst at hydrotreating conditions wherein a substantial portion of the nitrogen and sulfur-containing compounds are converted to hydrogen sulfide and ammonia to form a hydrotreating zone effluent;

passing at least a portion of the effluent from the hydrotreating zone to a stripping zone wherein hydrogen sulfide and ammonia are removed from the hydrotreating zone effluent to form a stripping zone effluent;

passing at least a portion of the stripping zone effluent containing less than about 10 ppmw nitrogen-containing compounds based on nitrogen and less than about 20 ppmw sulfur-containing compounds based on sulfur to a dewaxing zone wherein hydrogen is contacted with the stripping zone effluent at catalytic dewaxing conditions in the presence of a catalyst composition comprising a borosilicate molecular sieve and a hydrogenation component selected from the group consisting of Group VIB and Group VIII metals.

13. The process of claim 12 wherein the hydrogenation component is Group VIII noble metal comprising platinum.

14. The process of claim 12 wherein the hydrogenation component is a Group VIII noble metal comprising palladium.

15. The process of claim 12 wherein the crystalline borosilicate is dispersed within a non-molecular sieve containing porous refractory inorganic oxide matrix component.

16. The process of claim 15 wherein the hydrogenation component is deposited on the dispersion of borosilicate and matrix components.

17. The process of claim 15 wherein the hydrogenation component is deposited on the matrix component of the borosilicate-matrix dispersion.

18. The process of claim 15 wherein the matrix component comprises alumina.

19. The process of claim 12 wherein the borosilicate molecular sieve comprises an AMS-1B crystalline borosilicate molecular sieve.

20. The process of claim 12 wherein the borosilicate molecular sieve contains less than about 100 ppm sodium.

21. The process of claim 12 wherein the crystalline borosilicate molecular sieve is prepared by reacting under crystallization conditions, in the substantial absence of a metal or ammonium hydroxide, an aqueous mixture containing an oxide of silicon, an oxide of boron, and ethylenediamine, in a molar ratio to silica of above about 0.05.

22. The process of claim 12 wherein the crystalline borosilicate molecular sieve is prepared by reacting under cystallization conditions, in the substantial absence of a metal or ammonium hydroxide, an aqueous mixture containing an oxide of silicon, an oxide of boron, and ethylenediamine, in a molar ratio to silica of above about 0.05, wherein the borosilicate molecular sieve contains at least about 9,000 ppmw boron.

23. The process of claim 21 wherein the aqueous mixture further contains an alkylammonium cation or precursor of an alkylammonium cation.

24. The process of claim 22 wherein the aqueous mixture further contains an alkylammonium cation or precursor of an alkylammonium cation.

* * * * *